US008739433B2

(12) United States Patent
Da Riol et al.

(10) Patent No.: US 8,739,433 B2
(45) Date of Patent: Jun. 3, 2014

(54) HOUSEHOLD APPLIANCE FOR DRYING GARMENTS

(75) Inventors: Daniele Da Riol, Cordenons (IT); Luciano Sartor, Conegliano (IT); Michele Bisaro, Spilimbergo (IT); Massimo Castiglione, Fiume Veneto (IT)

(73) Assignee: Electrolux Home Products Corporation N.V., Brussels (BE)

( * ) Notice: Subject to any disclaimer, the term of this patent is extended or adjusted under 35 U.S.C. 154(b) by 393 days.

(21) Appl. No.: 13/142,926

(22) PCT Filed: Dec. 28, 2009

(86) PCT No.: PCT/EP2009/009277

§ 371 (c)(1), (2), (4) Date: Sep. 22, 2011

(87) PCT Pub. No.: WO2010/076005

PCT Pub. Date: Jul. 8, 2010

(65) Prior Publication Data

US 2012/0000087 A1 Jan. 5, 2012

(30) Foreign Application Priority Data

Dec. 30, 2008 (EP) ..... 08173061

(51) Int. Cl.
*F26B 21/00* (2006.01)

(52) U.S. Cl.
USPC ..... 34/595; 34/603; 34/607; 68/5 C; 68/5 R; 8/137; 38/104

(58) Field of Classification Search
USPC ..... 34/595, 601, 603, 606, 607, 610; 68/5 C, 20; 8/137, 149, 159; 38/103, 38/104, 137
See application file for complete search history.

(56) References Cited

U.S. PATENT DOCUMENTS 2,372,790 A * 4/1945 Morgenstern ..... 34/609
3,060,593 A * 10/1962 Flora et al. ..... 34/601

(Continued)

FOREIGN PATENT DOCUMENTS

EP 1 431 442 6/2004
EP 1 845 185 10/2007

(Continued)

OTHER PUBLICATIONS

International Search Report and Written Opinion mailed May 7, 2010 in corresponding International application No. PCT/EP2009/009277.

*Primary Examiner* — Steve M Gravini
(74) *Attorney, Agent, or Firm* — Banner & Witcoff, Ltd.

(57) ABSTRACT

A household appliance (100) comprises a cabinet (105) accommodating a drum for loading items to be dried and a drying air circuit for circulating drying air through the drum for drying the items therein. The drying air circuit comprises air heating elements (415) for heating the drying air fed to the drum, and the cabinet is provided with a worktop (110) defining a surface (130) having a plurality of apertures (135) in fluid communication with an air conveying system (205,225, 230) adapted to deliver a flow of air through said apertures. The air conveying system comprises an air duct (230) thermally coupled to the air heating elements in such a way as to cause heat generated by the air heating elements to heat the air to be delivered through the apertures in the drying surface.

8 Claims, 6 Drawing Sheets

(56) References Cited

U.S. PATENT DOCUMENTS

| | | | | |
|---|---|---|---|---|
| 3,905,125 | A * | 9/1975 | Hubner | 34/622 |
| 4,763,425 | A * | 8/1988 | Grennan | 34/552 |
| 4,819,341 | A * | 4/1989 | Gayso | 34/86 |
| 5,778,573 | A * | 7/1998 | Nottingham et al. | 38/103 |
| 8,234,797 | B2 * | 8/2012 | Jergens et al. | 34/499 |
| 8,286,369 | B2 * | 10/2012 | Dittmer et al. | 34/528 |
| 2004/0250442 | A1 * | 12/2004 | Ryu | 34/140 |
| 2006/0236560 | A1 * | 10/2006 | Doh et al. | 34/596 |
| 2007/0151120 | A1 * | 7/2007 | Tomasi et al. | 34/601 |
| 2008/0022551 | A1 * | 1/2008 | Banta et al. | 34/602 |
| 2008/0022552 | A1 * | 1/2008 | Forget | 34/602 |
| 2009/0064534 | A1 * | 3/2009 | LeClerc | 34/603 |
| 2009/0172965 | A1 * | 7/2009 | Campagnolo et al. | 34/72 |
| 2012/0000087 | A1 * | 1/2012 | Da Riol et al. | 34/108 |

FOREIGN PATENT DOCUMENTS

| | | | | |
|---|---|---|---|---|
| EP | 1 854 916 | | 11/2007 | |
| EP | 2204487 | A1 * | 7/2010 | D06F 58/20 |
| WO | WO 2010076005 | A1 * | 7/2010 | |

* cited by examiner

HOUSEHOLD APPLIANCE FOR DRYING GARMENTS

BACKGROUND OF THE INVENTION

The present invention relates in general to the field of household appliances, and more particularly to laundry drying appliances like laundry dryers and washer-dryers.

Garments made of delicate textile materials, such as cashmere, are not adapted to undergo regular drying treatments in a tumble dryer, owing to the mechanical stresses, mainly in the form of impacts, which the textile fibres would be subject to. More gentle drying treatments are thus recommendable for these delicate textiles, such as line drying or flat drying, which on the other hand are rather time-consuming processes.

The solutions disclosed in the European patent applications EP 1845185 and EP 1854916, both in the name of the present Applicant, are effective in eliminating the above cited drawbacks, by providing a household appliance that comprises a cabinet with a worktop defining a drying surface featuring a plurality of apertures, each one of which is fluidly connected to drying air conveying means adapted to deliver a flow of warm drying air towards and through said apertures, for gently but rapidly drying garments that are laid upon the worktop drying surface.

In the two cited applications, in order to warm up the flow of drying air to be conveyed through the apertures in the drying surface so as to dry the garments laid thereon, dedicated heating means are provided, for example electric heating elements arranged downstream air circulating means, i.e. a blower, that blow air into an air passage formed underneath the drying surface.

SUMMARY OF SELECTED INVENTIVE ASPECTS

The Applicant has found an effective solution for warming up the drying air to be conveyed to the drying surface of the worktop of an appliance of the type disclosed in the two cited applications.

According to an aspect of the present invention, a household appliance is provided comprising a cabinet accommodating a drum for loading items to be dried and a drying air circuit for circulating drying air through the drum for drying the items therein. The drying air circuit comprises air heating elements for heating the drying air fed to the drum, and the cabinet is provided with a worktop defining a surface having a plurality of apertures in fluid communication with an air conveying system adapted to deliver a flow of air through said apertures. The air conveying system comprises an air duct thermally coupled to said air heating elements in such a way as to cause heat generated by the air heating elements to heat the air to be delivered through said apertures in the drying surface.

The drying air circuit may comprise an air-cooled condenser for cooling the drying air exiting the drum and removing moisture therefrom, and the air duct is preferably arranged to collect the condenser cooling air after it has cooled the condenser.

An air circulation arrangement may be provided for causing air to flow through the air duct up to the drying surface.

The air circulation arrangement may comprise a blower provided in the cabinet for taking in from the outside ambient air for cooling the condenser.

The air circulation arrangement may alternatively or in addition comprise a blower provided in the air conveying system for taking in from the outside ambient air and forcing it to flow through the apertures of said surface.

The air duct may in particular be arranged along a back wall of the cabinet. Preferably, the air duct may be arranged to be in close proximity to said air heating elements.

Preferably, a wall separating the air duct from the heating elements may be in thermally conductive material, particularly in metal.

These and other features and advantages of the present invention will become apparent by reading the following detailed description of some embodiments thereof. For better intelligibility, the description should be read in conjunction with the attached drawings, wherein:

DETAILED DESCRIPTION OF EXAMPLE EMBODIMENTS

Figure 1:
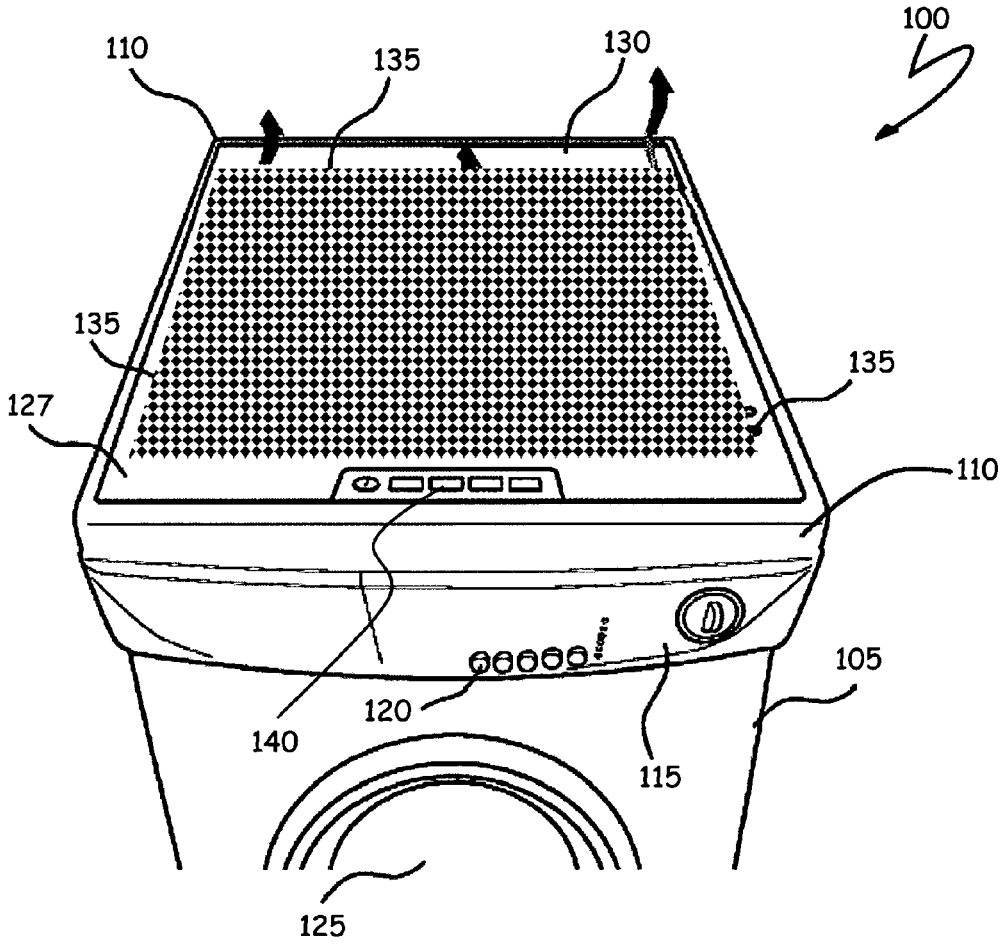
FIG. 1 shows in perspective a household appliance wherein a solution according to an embodiment of the present invention is exploitable.

Making reference to the drawings, in FIG. 1 there is shown in perspective a household appliance 100, particularly a laundry dryer or washer/dryer for drying or washing and drying clothes and garments, of the type described in detail in the European patent application EP 1845185, which is incorporated herein in its entirety by reference. The household appliance 100 comprises an outer casing 105 with a worktop 110 and a front panel 115 carrying operational input and setting controls 120 for the user. A drum (not visible in the drawing), adapted to be loaded with the items to be dried or washed and dried, is rotatably accommodated and supported within a tub also accommodated in the casing 105, and an opening in the front panel of the casing 105 allows access to the tub for loading/unloading the items into/from the tub; the opening is closable by a door 125.

The worktop 110 comprises a top plate member 127, for example in plastic or metal, which defines a drying surface 130, on which the garments to be gently dried (without submitting them to the stresses experienced by the items dried in the drum) are laid. The drying surface 130 has a plurality of apertures or perforations 135, each one of which is fluidly connected to drying air conveying means adapted to direct a flow of drying air through the apertures 135; the air flowing through the apertures 135 hits the garment(s) that is (are) laid upon the drying surface 135, thereby drying it (them) quickly and gently.

Figure 2:
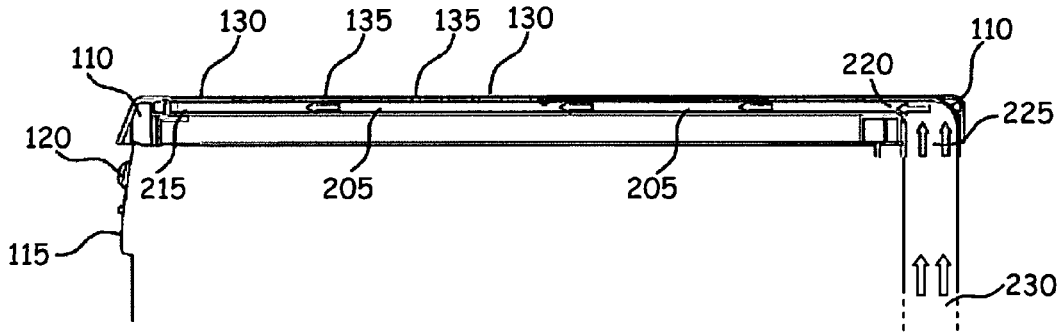
FIG. 2 shows in cross-section and in enlarged scale a detail of a worktop of the household appliance of FIG. 1, in an embodiment of the present invention.

As depicted in FIG. 2, the drying air conveying means may comprise at least an air passage 205, formed in the worktop 110, adapted to convey the drying air underneath the drying surface 130, so that the drying air is then able to flow through the apertures 135 from the bottom upwards.

The air passage 205 extends horizontally along and underneath the drying surface 130, so as to be able to supply the drying air to every aperture 135 essentially at the same time. An end portion 215 of the air passage 205 is blind, i.e. sealed, whereas the other end portion 220 thereof is open to receive the flow of drying air thereinto.

The air passage 205 has, at a rear thereof, in correspondence of the open end portion 220, an elbow 225 that is connected to an air communication duct 230 located at the back of the cabinet 105, and conveying the drying air into the air passage 205.

Figure 3:
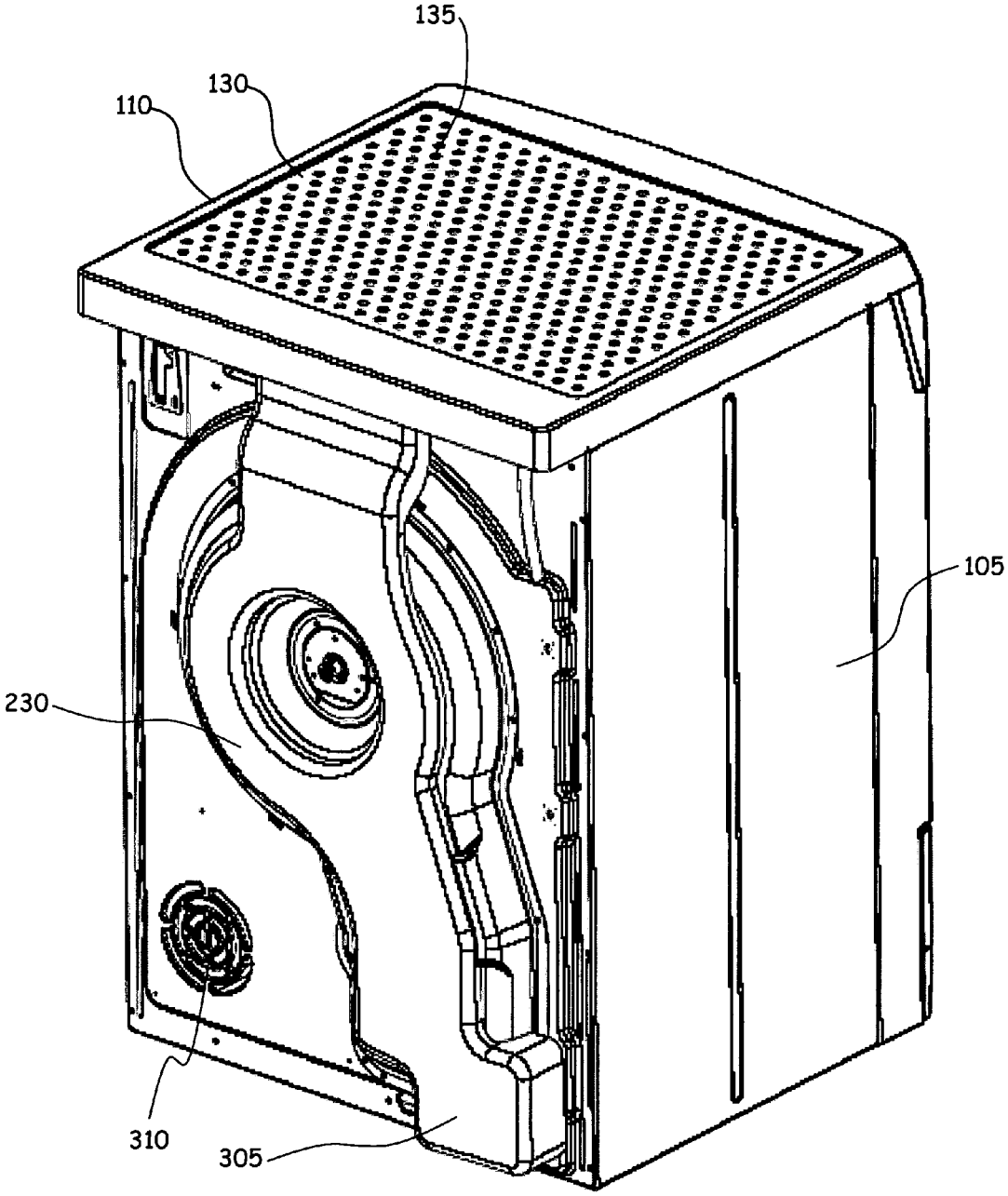
FIG. 3 is a perspective view from the back of the household appliance of FIGS. 1 and 2, in an embodiment of the present invention.
Figure 4:
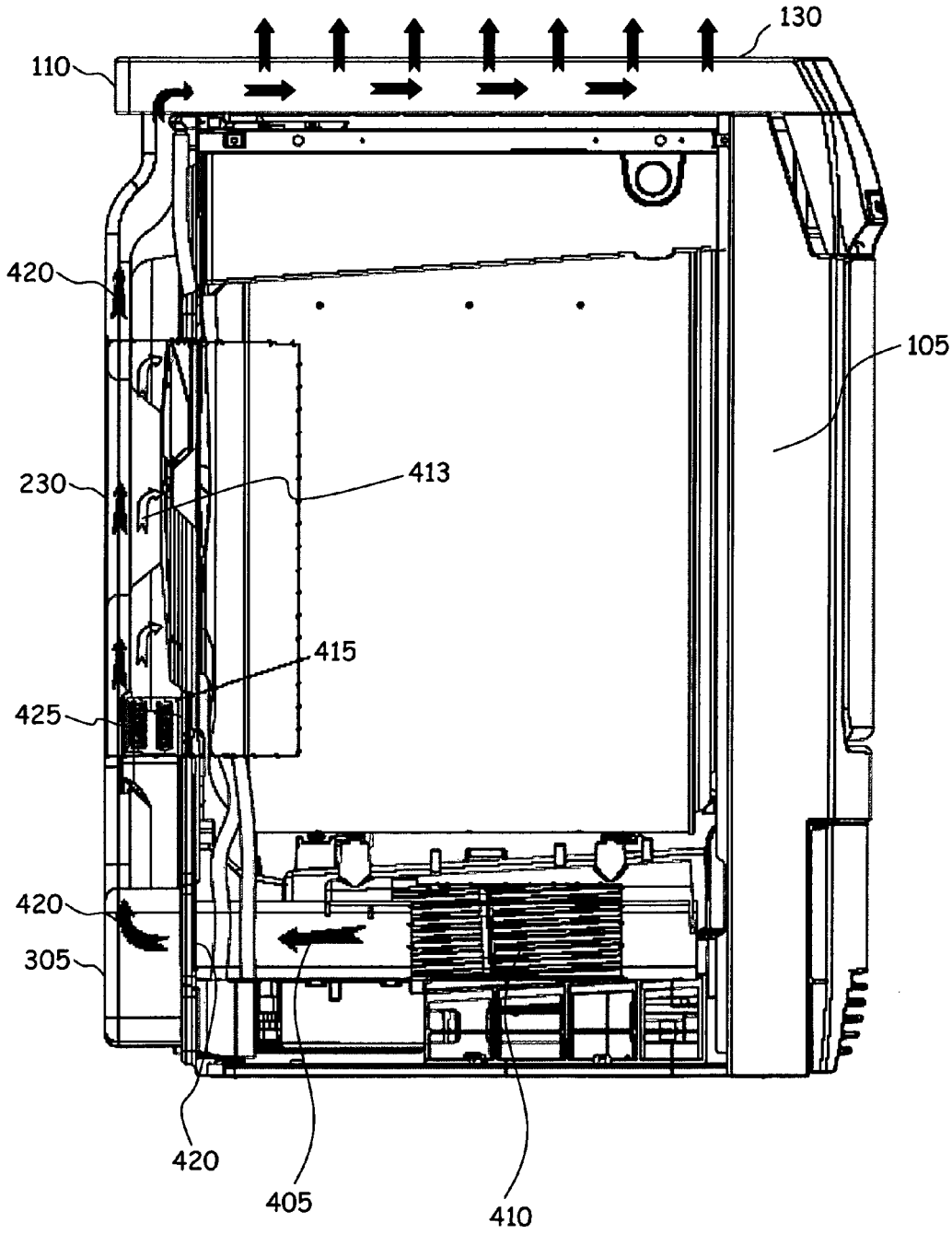
FIG. 4 is a side view, partially in cross-section, of the household appliance of FIG. 3.

As visible in FIGS. 3 and 4, in an embodiment of the present invention the air communication duct 230 extends from the bottom of the cabinet 105 to the worktop 110. The air communication duct 230 receives a flow of cooling air 405 of a condenser 410 of the household appliance 100.

The condenser 410 is part of a closed-loop drying air circuit, adapted to cause drying air 413 to circulate through the rotatable drum of the household appliance 100; Heating means 415, e.g. an electric heater, are provided in the closed-loop drying air circuit, downstream the condenser 410, so as to heat the drying air to be circulated through the drum.

Through the closed-loop drying air circuit, the hot and moisture-laden drying air is caused to leave the rotatable drum and is conveyed towards the air-cooled condenser; then, the dehydrated drying air exiting the condenser is sent back into the drum, upon having been heated up again by the heating means 415, so as to remove additional moisture from the clothes being tumbled in the drum.

Figure 5:
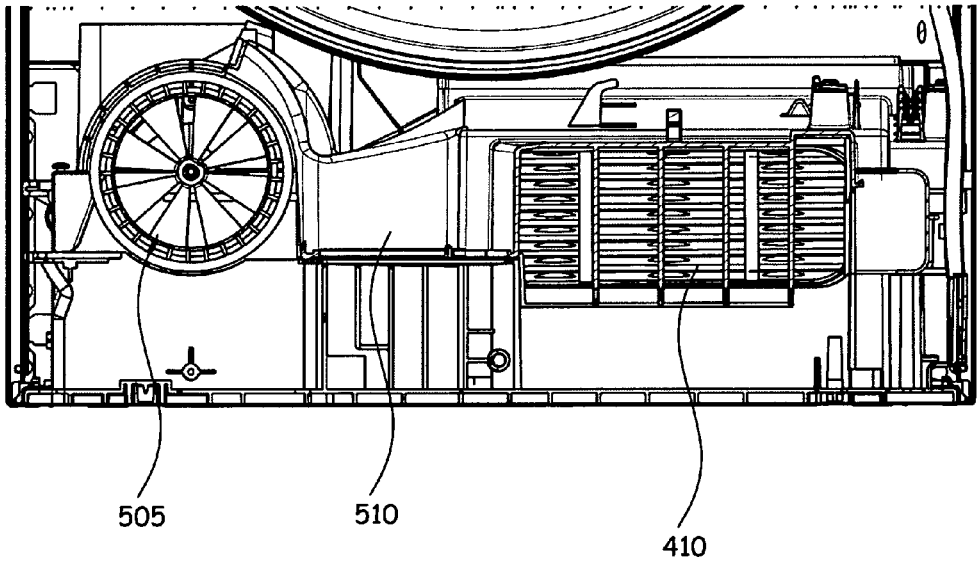
FIG. 5 is a partial view from the rear of the inside of the household appliance of FIG. 3 (with a rear wall of the appliance cabinet removed)

The condenser 410 is an air/air heat exchanger, adapted to remove moisture from the hot moisture-laden drying air exiting the drum; the condenser 410 is inserted in an open-loop cooling air circuit adapted to circulate through the air-cooled condenser a stream of cooling air, which is taken in from the outside ambient to cool said condenser; air circulating means, e.g. a blower 505 visible in FIG. 5 is normally provided for causing the condenser cooling air to be taken in, through an air intake aperture 310 provided in the rear wall of the cabinet 105, from the outside ambient and to be conveyed by means of a cooling air conveyor 510 so as to pass through the condenser 410. The condenser 410 comprises a plurality of fluid passageways, along which the clothes drying air is able to flow for having the moisture condensed and removed therefrom, and these fluid passageways are exposed to the flow of cooling air flowing in the open-loop cooling air circuit. When the cooling air passes through the condenser, the drying air temperature is lowered and heat is transferred to the cooling air.

An example of household appliance having the described closed-loop drying air circuit and open-loop cooling air circuit is provided in the European patent application No. 1936022 in the name of the present Applicant.

Normally, the condenser cooling air, after having cooled the condenser 410, is returned to the outside ambient through an exhaust aperture 420 provided for example in a rear wall of the cabinet 105.

According to an embodiment of the present invention, the flow of cooling air used to cool the condenser, which is warm due to the transfer of heat occurring in the condenser 410, instead of being released into the ambient, is taken in by the air communication duct 230, which at its bottom end 305 has an aperture facing the exhaust aperture 420 in the cabinet 105; in this way the air communication duct 230 is fluidly connected to the condenser 410 for receiving condenser cooling air. The air communication duct 230 conveys the warm condenser cooling air 405 up to the air passage 205 underneath the drying surface 130, and thus the warm condenser cooling air 405 is advantageously exploited for gently drying the garments laid on the drying surface 130, without the need of providing dedicated heating means, as were provided in the solutions of the cited applications EP 1845185 and EP 1854916.

Advantageously, the air communication duct 230 is thermally coupled to the heating elements 415 provided in the closed-loop drying air circuit of the household appliance 100 for heating up the drying air to be conveyed to the drum, particularly, as visible in FIG. 4, the air communication duct 230 is arranged in close proximity to the heating elements 415. Preferably, a wall 425 separating the closed-loop drying air circuit and the air communication duct 230 is, at least in correspondence with the heating elements 415, made of thermally conductive material, e.g. metal. In this way, the drying air which passes through the air communication duct 230 to be conveyed to the drying surface 130 is further heated up.

In this way, both the provision of heating elements dedicated to heating the drying air to be conveyed to the drying surface 130, and the provision of air circulating means, e.g. a blower, dedicated to the circulation of the drying air to be conveyed to the drying surface 130 may be dispensed for. In fact, the drying air used for drying garments laid on the drying surface 130 is forced to circulate through the air passage 205 and the apertures 135 by the blower that is provided in the open-loop cooling air circuit for taking in cooling air from the outside ambient and pass through the condenser 410; the condenser cooling air is already warm due to the transfer of heat occurring in the condenser 410, wherein the hot drying air coming from the drum releases heat to the condenser cooling air, and, passing close to the heating means 415, the air conveyed to the drying surface is further heated up.

Figure 8:
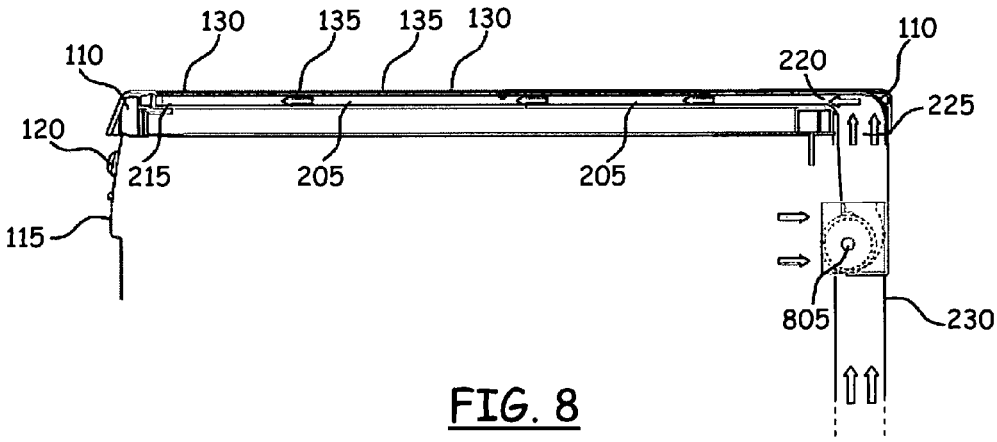
FIG. 8 shows, in a view similar to that of FIG. 2, a detail of the worktop of the household appliance of FIGS. 6 and 7.
Figure 6:
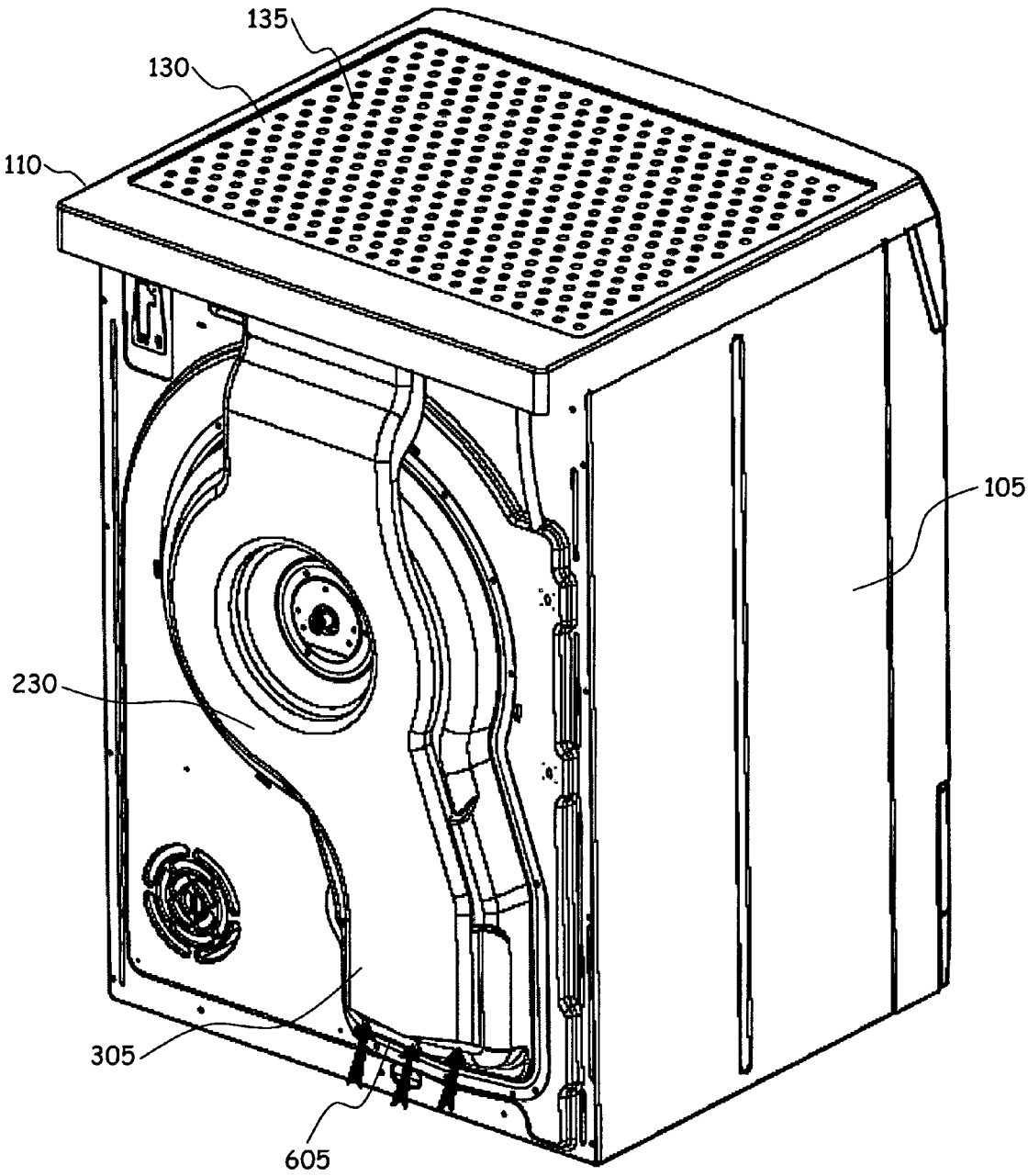
FIG. 6 is a perspective view from the back of a household appliance according to another embodiment of the present invention.
Figure 7:
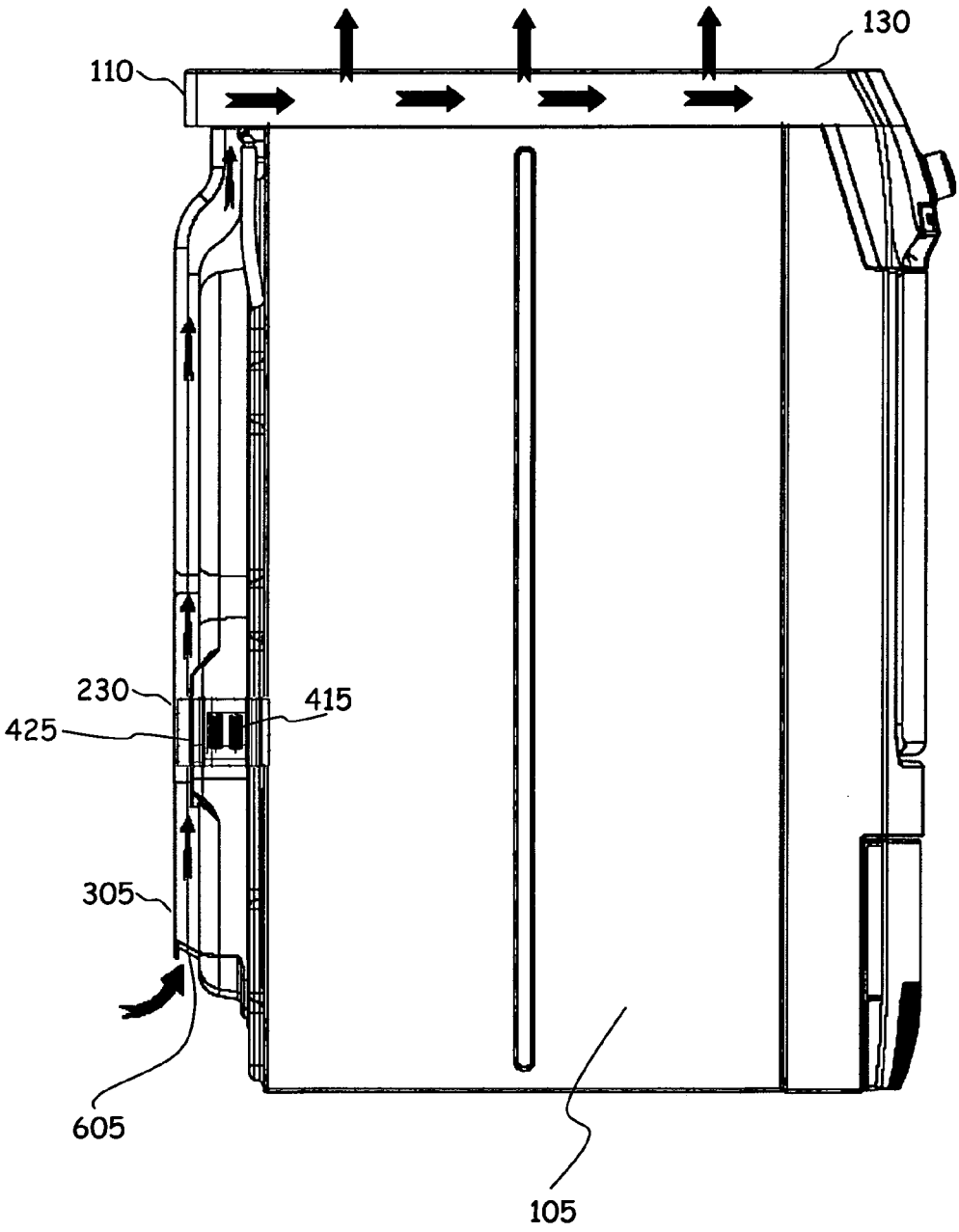
FIG. 7 is a side view of the household appliance of FIG. 6.

In an alternative embodiment of the present invention, instead of exploiting the condenser cooling air, air taken in from either the outside ambient or the interior of the cabinet 105 (which, being normally not air-tight, is in fluid communication with the outside ambient) may be exploited for drying the garments laid on the drying surface 130. In this case, as depicted in FIGS. 6 and 7, the aperture in the bottom end 305 of the air communication duct 230 needs not to face the exhaust aperture 420 provided in the cabinet 105 for discharging the condenser cooling air; instead, an aperture 605 may be provided in the bottom end 305 of the air communication duct 230 adapted to take in air from the external ambient. Also, as visible in FIG. 8, air circulating means 805, e.g. a blower dedicated for taking in air through the aperture 605 and for circulating the drying air to be conveyed to the drying surface 130 are provided, accommodated for example upstream the elbow 225, as disclosed for example in the European patent application EP 1845185, for causing air to flow up the air communication duct 230. In any case, as in the previous invention embodiment, the air communication duct 230 is thermally coupled to the heating elements 415 provided in the closed-loop drying air circuit of the household appliance 100 for heating up the drying air to be conveyed to the drum, particularly, the air communication duct 230 is arranged in closed proximity to the heating elements 415, and preferably the wall 425 separating the closed-loop drying air circuit and the air communication duct 230 is, at least in correspondence of the heating elements 415, made of thermally conductive material, e.g. metal. The air communication duct 305, passing in close proximity to the heating elements 415 provided in the closed-loop drying air circuit of the household appliance 100 for heating up the air to be conveyed to the drum, allows heating the air without the necessity of providing dedicated heating means.

This second embodiment of the invention, compared to the first embodiment described, does not require that the closed-loop drying circuit of the household appliance be activated for drying garments laid upon the drying surface. The commands for the operation of the air circulating means 805 and the heating elements 415 may be placed/integrated on the worktop 110, as shown in FIG. 1 where the commands are denoted 140.

Preferably, the heating elements 415 in the closed-loop drying air circuit of the household appliance, and the air circulating means for taking in condenser cooling air or the air circulating means 805, are activatable under command of the user also when the drying cycle of the clothes in the drum of the household appliance is not to be started, but there are garments laid upon the drying surface 130 to be dried.

The present invention can be advantageously applied to any household appliance having a worktop defining a drying surface for gently drying garments; in particular, the present invention is applicable to any one of the household appliance embodiments described in the cited applications EP 1845185 and EP 1854916; in particular, the present invention is applicable to the household appliance in which the worktop comprises a drawer-like element having a perforated drying surface that can be extracted from the worktop to increase the overall drying surface or to facilitate the usage of the drying surface in case of obstacles that prevent the user from laying garments directly on the worktop.

The present invention has been here disclosed by presenting some embodiments thereof, however those skilled in the art will readily recognize that several modifications to the described embodiments, as well as several alternative embodiments are possible, without departing from the scope of the appended claims.

The invention claimed is:

1. A household appliance comprising a cabinet accommodating a drum for loading items to be dried and a drying air circuit for circulating drying air through the drum for drying the items therein, said drying air circuit comprising air heating elements for heating the drying air fed to the drum, and wherein the cabinet is provided with a worktop defining a surface having a plurality of apertures in fluid communication with an air conveying system adapted to deliver a flow of air through said apertures, wherein said air conveying system comprises an air duct having a wall which separates the flow of air in the drying air circuit from the flow of air in said air conveying system and prevents the latter from passing through the air heating elements, the air duct of said air conveying system being thermally coupled to said air heating elements through said wall in such a way as to cause heat generated by the air heating elements to heat the air flowing in the air duct to be delivered through said apertures in the drying surface.

2. A household appliance of claim 1, wherein said drying air circuit comprises an air-cooled condenser for cooling the drying air exiting the drum and removing moisture therefrom, and wherein the air duct is arranged to collect the condenser cooling air after it has cooled the condenser.

3. The household appliance of claim 1, comprising an air circulation arrangement for causing air to flow through the air duct up to the drying surface.

4. The household appliance of claim 3, wherein said air circulation arrangement comprises a blower provided in the cabinet for taking in from the outside ambient air for cooling the condenser.

5. The household appliance of claim 3, wherein said air circulation arrangement comprises a blower provided in the air conveying system for taking in from the outside ambient air and forcing it to flow through the apertures of said surface.

6. The household appliance of claim 1, wherein said air duct is arranged along a back wall of the cabinet.

7. The household appliance of claim 1, wherein said air duct is arranged to be in close proximity to said air heating elements.

8. The household appliance of claim 7, wherein said wall separating said air duct from said heating elements comprises a thermally conductive metal material.

* * * * *